United States Patent [19]

Collins

[11] 3,987,518

[45] Oct. 26, 1976

[54] BELT RETAINER

[75] Inventor: Robert F. Collins, Barrington, Ill.

[73] Assignee: The Kendall Company, Boston, Mass.

[22] Filed: Jan. 22, 1975

[21] Appl. No.: 542,999

[52] U.S. Cl. ..... 24/31 R; 2/338

[51] Int. Cl.[2] ..... F16G 3/00; A41B 9/00

[58] Field of Search ..... 24/31 R, 16 R; 2/114, 2/300, 338, 69.5, 93, 114, 155, 156, DIG. 7, 338; 206/63.2, 46 AP; 161/132

[56] References Cited

UNITED STATES PATENTS

| | | | |
|---|---|---|---|
| 3,359,569 | 12/1967 | Rotanz et al. | 206/278 X |
| 3,594,818 | 7/1971 | Planner | 2/114 |
| 3,648,290 | 3/1972 | Hartigan | 2/114 |
| 3,754,284 | 8/1973 | Hartigan et al. | 2/338 |

*Primary Examiner*—Paul R. Gilliam
*Assistant Examiner*—Andrew M. Calvert
*Attorney, Agent, or Firm*—Powell L. Sprunger

[57] ABSTRACT

A belt assembly for an operating room gown comprising, an elongated belt associated with the gown and having an end section for closing the gown. The belt assembly has a protective member removably positioned on and covering an outer end of the one end section to prevent contamination of the one end section while handling the belt. The belt assembly also has means for releasably retaining the protective member on the outer end of the belt to prevent the protective member from prematurely slipping from the belt.

9 Claims, 15 Drawing Figures

BELT RETAINER

BACKGROUND OF THE INVENTION

The present invention relates to operating room gowns, and more particularly to belt assemblies for such gowns.

Operating rooms gowns are generally made with an open back to prevent possible contamination to the sterile gown front, and are provided with various devices for closing the gown, such as a belt. According to a preferred procedure, after the surgeon or other user dons the gown, he grasps one end of the belt which is positioned for easy access to the surgeon's hand, while the other end of the belt is brought around the opposite side of the gown by another person in the operating room, such as a nurse. After being handed the other end of the belt, the surgeon ties the ends of the belt to close the gown. Since it is desirable that the nurse may handle the other belt end without requiring that her hands are sterile, the outer end of the other belt end is normally covered by a protective member to prevent contamination to the gown belt during handling. After the nurse hands the other belt end to the surgeon, the protective member is pulled off the belt by the nurse.

Although the procedure for placing the gown is satisfactory in theory, certain difficulties have been encountered during placement of the gown resulting from loose fitment of the protective member on the outer end of the belt. Accordingly, the protective member occasionally slides off the belt before the nurse has handed the belt end to the surgeon. If the free belt end falls to a position below the surgeon's waist, which is considered a non-sterile area of the gown, it is assumed that the belt end has become contaminated by contact with the lower part of the gown. Accordingly, the first gown must be removed, and the procedure must be started anew with a second sterile gown. Even if the belt end does not fall to a non-sterile location on the gown, the belt end is no longer protected from contamination by the protective member. Accordingly, the nurse must sterilize her hands in order to grasp the belt end, or the belt end must be grasped with a sterile instrument, such as a pair of forceps, to prevent contamination to the belt, resulting in inconvenience and wasted time to the operating team.

SUMMARY OF THE INVENTION

A principal feature of the present invention is the provision of a belt assembly for an operating room gown of simplified construction which prevents contamination to a belt for the gown.

The belt assembly of the present invention comprises, an elongated belt associated with the gown and having at least one end section for closing the gown. The belt assembly has a protective member removably positioned on and covering an outer end of the one end section to prevent contamination of the one end section while handling the belt. The belt assembly also has means for releasably retaining the protective member on the outer end of the belt.

A feature of the present invention is that the protective member permits handling of the belt by non-sterile hands without contaminating the belt.

Another feature of the invention is that the retaining means prevents premature release of the protective member from the belt during handling of the protective member by the nonsterile hands.

Yet another feature of the invention is that the protective member may be removed from the belt when desired by pulling on the protective member.

Still another feature of the invention is that the protective member is retained on the belt by releasably interlocking the protective member and the outer end of the belt together.

Further features will become more fully apparent in the following description of the embodiments of this invention and from the appended claims.

DESCRIPTION OF THE PREFERRED EMBODIMENTS

Figure 1:
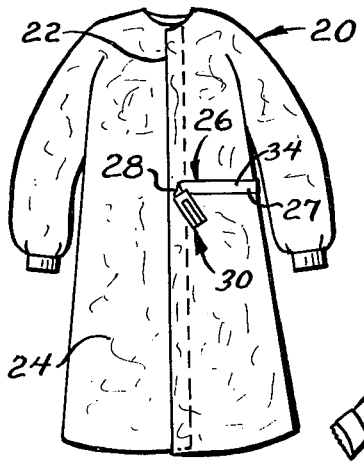
FIG. 1 is a perspective view of an operating room gown taken from the back of the gown and showing a belt assembly of the present invention.
Figure 2:
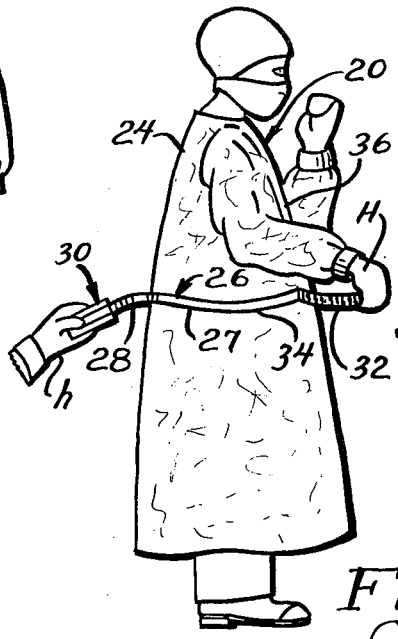
FIGS. 2–6 are perspective views illustrating steps taken by a wearer and aide in placing the gown on the surgeon.

Referring now to FIG. 1, there is shown an operating room gown generally designated 20 having an opening 22 in the back 24 of the gown and a belt assembly generally designated 26 secured to the gown. As shown in FIGS. 1 and 2, the belt assembly 26 has a belt 27 having a first end section 28 extending from the gown back adjacent the opening 22, a second end section 32 extending from the gown located adjacent the front 36 of the gown for grasping by the hand of a wearer, and an intermediate section 34 connecting the first and second end sections 28 and 32 and being secured to the gown. The belt 27 may be made of any suitable material such as Tyvek, a trademark of I.E. du Pont de Nemours, and the first and second end sections 28 and 32 of the belt are preferably micropleated or microcreped such that they may be extended from a compacted configuration, as described in U.S. Pat. No. 3,754,284. As shown, the belt assembly 26 also has a protective member 30 covering an outer end of the first end section 28.

Figure 3:
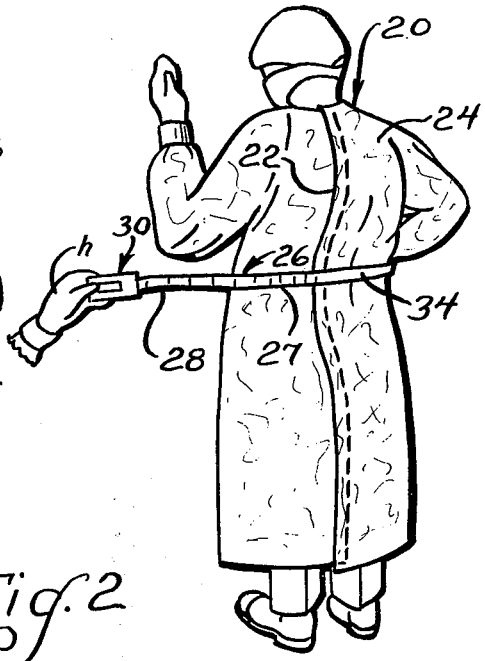
Figure 4:
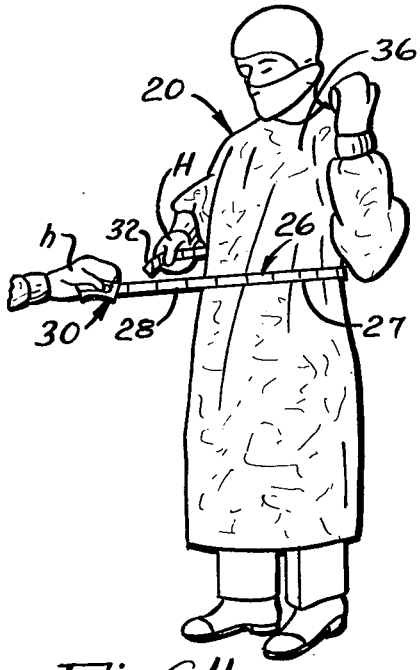
Figure 5:
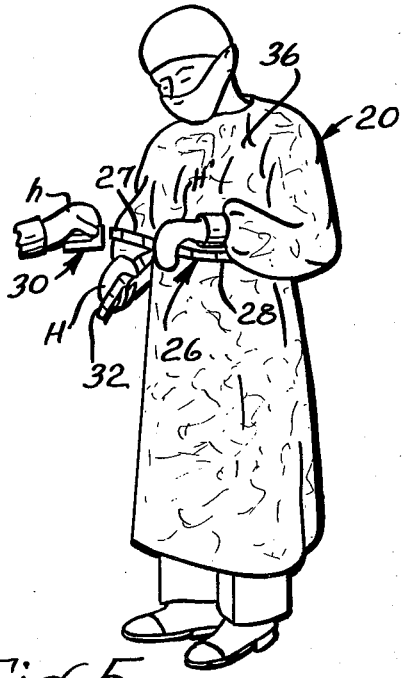
Figure 6:
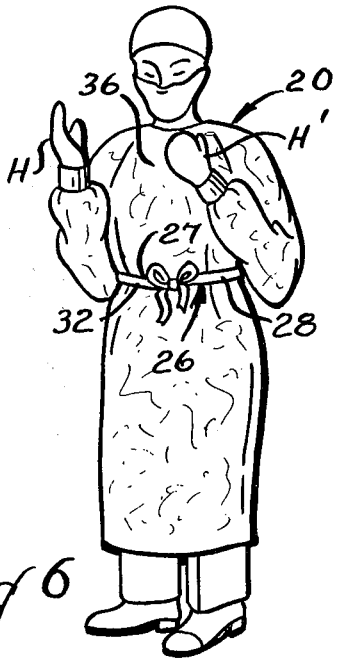

After the wearer, such as a surgeon, dons the gown the protective member 30 is grasped by the non-sterile hand h of an aide, such as a nurse, while the second end section 32 is grasped by the sterile hand H of the surgeon. As shown in FIGS. 3 and 4, the nurse extends the compacted first end section 28 of the belt 27, and brings the outer end of the first end section 28 around the front 36 of the gown, while closing the opening 22 on the back 24 of the gown 20. As shown in FIG. 5, the surgeon grasps the first end section 28 of the belt 27 with his other hand H′, after which the nurse removes the protective member 30 from the first end section 28 of the belt. Finally, as illustrated in FIG. 6, the surgeon ties the first and second end sections 28 and 32 of the belt 27 to close the gown, thus completing placement of the gown 20 on the surgeon in a sterile manner.

Figure 7:
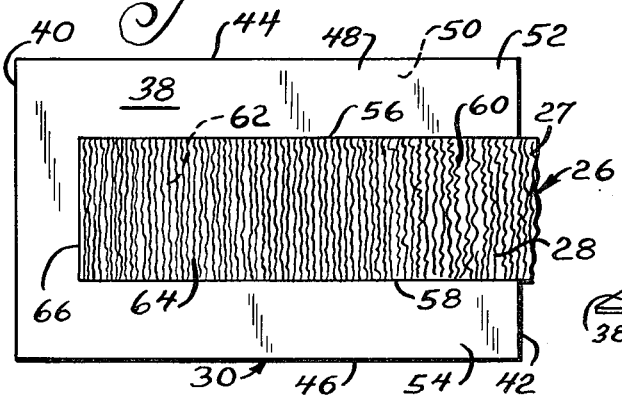
FIG. 7 is a fragmentary plan view of the partially formed belt assembly of the present invention.

Referring now to FIG. 7, the protective member 30 comprises a sheet 38 of flexible material, such as paper, having a greater width than the belt 27, an outer end edge 40, a second inner end edge 42, a pair of side edges 44 and 46 connecting the end edges 40 and 42, an inner surface 48, an outer surface 50, and a pair of opposed side margins 52 and 54 extending past side edges 56 and 58 of the belt 27. An outer end 60 of the first end section 28 is positioned against the sheet 38 with a first surface 62 of the belt facing the inner surface 48 of the sheet, and with a second surface 64 of the belt facing away from the sheet 38. In the present embodiment, an outer end edge 66 of the belt may be spaced from the outer end edge 40 of the sheet 38, as shown.

Figure 8:
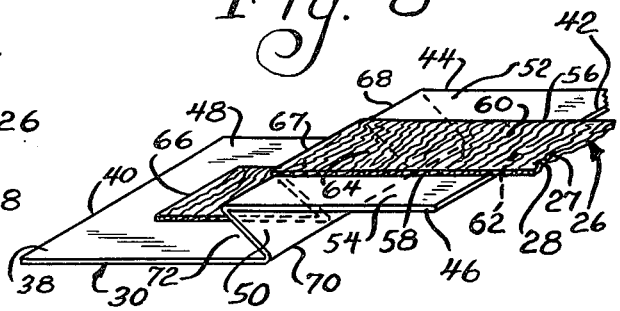
FIG. 8 is a fragmentary perspective view illustrating a step in the formation of the belt assembly of the present invention.

As illustrated in FIG. 8, both the sheet 38 and outer belt end 60 have a lateral pleat or tuck 67 along laterally extending first and second fold lines 68 and 70, with the first fold line or edge 68 overlying the belt and the inner surface 48 of the sheet 38, and with the first fold line 68 being located intermediate the second fold line 70 and the outer end edge 40 of the sheet 38. The pleat 67 of the sheet 38 defines a pocket 72 facing toward the outer end edge 40 of the sheet 38, and receiving the pleated portion of the outer belt end 60. As will be seen below, the pleats of the sheet 38 and belt 27 serve to releasably interlock or interleave the sheet and belt together.

Figure 9:
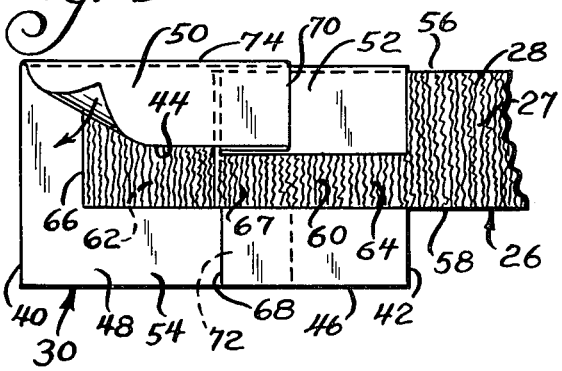
FIGS. 9–11 are fragmentary plan views illustrating further steps in the formation of the belt assembly of the present invention.
Figure 10:
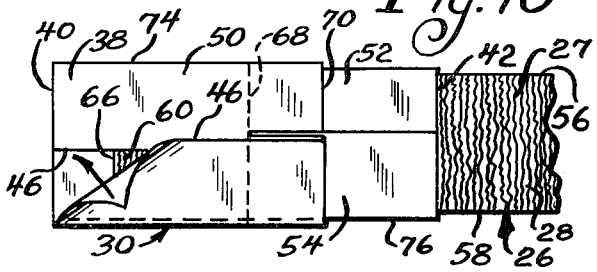

As shown in FIG. 9, one of the sheet side margins 52 is folded over the second surface 64 of the outer belt end 60, with the inner surface 48 of the side margin 52 facing the second surface 64 of the belt 28, and with the side margin 52 being folded along a longitudinally extending fold line 74 adjacent the side edge 56 of the belt 27. The width of the side margin 52 is preferably less than the width of the belt, such that the side edge 44 of the folded sheet 38 is located intermediate the side edges 56 and 58 of the belt. As shown in FIG. 10, the other side margin 54 is then folded along a longitudinally extending fold line 76 adjacent the side edge 58 of the belt, such that the side margin 54 overlaps the side margin 52, with the inner surface 48 of the side margin 54 facing the outer surface 50 of the side margin 52. Preferably, the width of the side margin 54 is less than the width of the belt 27, such that the side edge 46 of the sheet 38 is located intermediate the fold lines 74 and 76.

Figure 11:
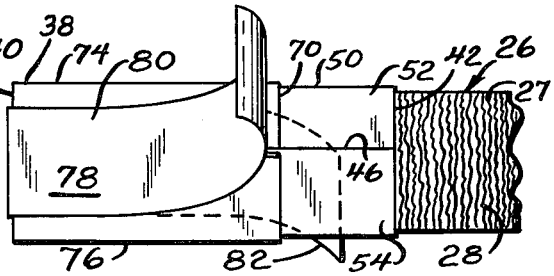
Figure 13:
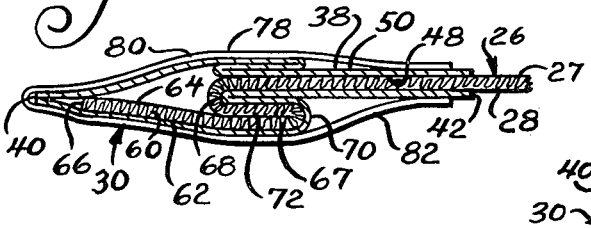
FIG. 13 is a sectional view taken substantially as indicated along the line 13—13 of FIG. 12.
Figure 12:
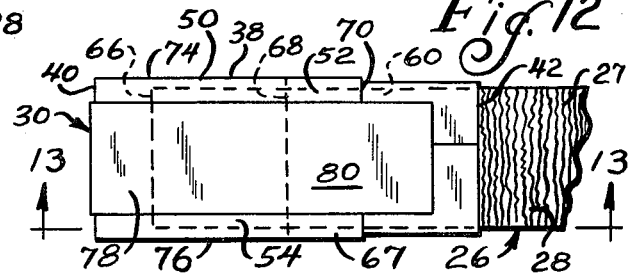
FIG. 12 is a fragmentary plan view of the belt assembly of the present invention.

As shown in FIG. 11, the side margins 52 and 54 are secured together in their overlapped position by suitable means, such as a tape stripe 78, or by adhesive as will be described below. The tape strip 78 has one end section 80 secured to the outer surface 50 of the side margins 52 and 54, such that the end section 80 extends on both lateral sides of the side edge 46 of the side margin 54. Preferably, the tape strip 78 extends past and around the outer end edge 40 of the sheet 38, with a second end section 82 being secured to the outer surface of the sheet 38 on the back side of the protective member 30 and intermediate the fold lines 74 and 76. The tape strip may be colored, if desired, to indicate that the protective member may be grasped by non-sterile hands. As shown in FIGS. 12 and 13, in this configuration the protective member 30 covers the outer end 60 of the belt 27 and protects it from contamination by the non-sterile hands of the nurse when the protective member 30 is handled. Since the end edge 66 of the belt 27 is spaced from the end edge 40 of the sheet 38, the edge is protected from contamination inside the protective member 30, and the tape strip 78 closes the outer end of the sheet 38 to further protect the outer belt end. As previously discussed, the pleat or tuck 67 formed by the lateral fold lines 68 and 70 serve to releasably interlock the outer end 60 of the belt 27 in the sheet 38 of the protective member 30. Accordingly, the interlocked pleats prevent premature release of the protective member 30 from the belt during handling of the protective member, and prevent possible contamination to the belt which may result if the released belt end contacts a non-sterile lower part of the gown. When the first end section 28 of the belt is brought into proper position by the protective member 30 for grasping of the belt by the surgeon, as previously described, the surgeon grasps the belt and the nurse may remove the protective member 30 from the belt by pulling on the protective member. The pleat of the belt 27 then unfolds from the pleat of the sheet 38 or unfolds the sheet pleat, or both, and the outer end 60 of the belt 27 passes out of the protective member 30.

Figure 14:
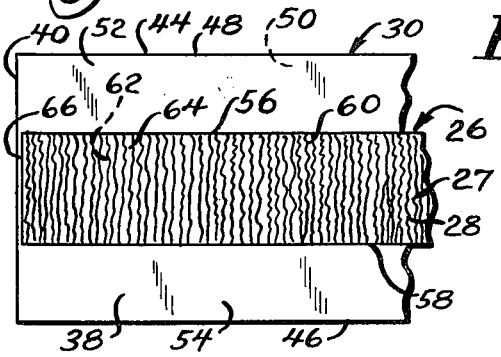
FIGS. 14 and 15 are fragmentary plan views of another embodiment of a partially formed belt assembly of the present invention.
Figure 15:
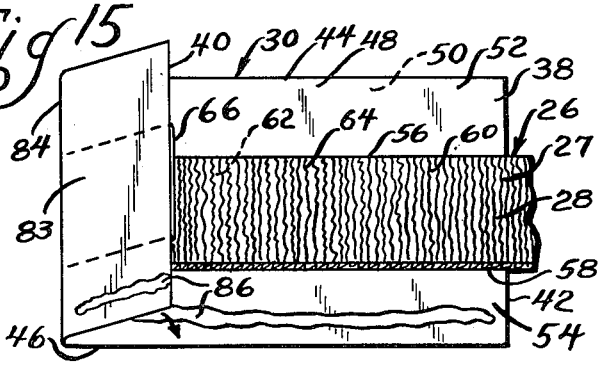

Another embodiment of the belt assembly of the present invention is illustrated in FIGS. 14 and 15, in which like reference numerals designate like parts. In this embodiment, the end edge 66 of the outer belt end 60 is located in the proximity of the outer end edge 40 of the sheet 38. In this embodiment, the outer end margin 83 of the sheet 38 and belt 27 are folded along a laterally extending fold line 84, such that the end margin 83 of the sheet and belt overlie the inner surface 48 of the sheet 38 and the second surface 64 of the one belt end 60 to ensure that the end margin of the belt 27 is protected from contamination during manipulation of the protective member 30. After the end margin 83 has been folded, as illustrated in FIG. 15, the belt and sheet are further folded in a manner similar to that described in connection with FIGS. 8–10, and the folded assembly may then be secured by the tape strip 78, if desired, as described in connection with FIGS. 11–13. Alternatively, as shown in FIG. 15, the side margin 54 of the sheet 38 may be secured to the outer surface 50 of the side margin 52 by a line of adhesive 86. It will be apparent that adhesive may also be used to secure the opposed side margins 52 and 54 of the protective member described in connection with FIGS. 7–13, if desired. It is also apparent that the end margin 83 of the belt 27 in the belt assembly described in connection with FIGS. 14 and 15 will readily pass out of the protective member 30 when the nurse removes the protective member from the belt.

The foregoing detailed description is given for clearness of understanding only, and no unnecessary limitations should be understood therefrom, as modifications will be obvious to those skilled in the art.

I claim:

1. A belt assembly for an operating room gown, comprising:

an elongated belt associated with the gown and having an end section for closing the gown, said end section having a pair of side edges, an outer end edge, and first and second opposed surfaces; and a protective member for the belt comprising, an outer end a sheet of flexible material covering an outer end of said one end section, said sheet having an inner surface facing the belt, a lateral pleat defining first and second fold lines, with said first fold line overlying the inner surface of said sheet and being located intermediate the second fold line and said outer end edge of the protective member, said belt having a pleat interleaved with the pleat of said sheet to releasably retain the outer end of the belt in the protective member.

2. The belt assembly of claim 1 wherein said outer belt end and sheet are laterally folded together to define the pleats in the outer belt end and sheet.

3. The belt assembly of claim 1 wherein the first surface of the outer belt end faces the inner surface of said sheet, with opposed lateral side margins of the sheet extending past the side edges of the outer belt end, with one of said side margins being folded against the second surface of the outer belt end, and with the other of the side margins being folded over an outer surface of the one side margin, and including means for securing the overlapped side margins together.

4. The belt assembly of claim 3 wherein the securing means comprises adhesive intermediate the overlapped side margins.

5. The belt assembly of claim 3 wherein the securing means comprises a tape strip attached to the outer surfaces of the side margins of said sheet.

6. The belt assembly of claim 5 wherein the tape strip extends past an outer end edge of the sheet, and has a portion secured to the outer surface of the sheet intermediate said opposed side margins.

7. The belt assembly of claim 1 wherein the end edge of the belt is spaced from an outer end edge of the sheet.

8. The belt assembly of claim 1 wherein the end edge of the belt is located in the proximity of an outer end edge of said sheet, and including a lateral fold of the sheet and belt along a lateral fold line spaced slightly from the outer end edge of the sheet to position the end edge of the belt inside the protective member.

9. The belt assembly of claim 3 wherein the end edge of the belt is located in the proximity of an outer end edge of said sheet, and including a lateral fold of the sheet and belt along a lateral fold line spaced slightly from the outer end edge of the sheet to position the end edge of the belt inside the protective member, and in which the spaced lateral fold is made prior to folding said opposed side margins of the sheet.

* * * * *